US010685590B2

(12) United States Patent
Muir

(10) Patent No.: US 10,685,590 B2
(45) Date of Patent: Jun. 16, 2020

(54) FLAG ASSEMBLY FOR MITIGATING AGAINST FLAG ENTANGLEMENT AND A METHOD OF ASSEMBLY THEREOF

(71) Applicant: The Flag Pole Company Pty Ltd, Metung (AU)

(72) Inventor: Robert Muir, Metung (AU)

( * ) Notice: Subject to any disclaimer, the term of this patent is extended or adjusted under 35 U.S.C. 154(b) by 203 days.

(21) Appl. No.: 15/522,928

(22) PCT Filed: Oct. 28, 2015

(86) PCT No.: PCT/AU2015/050674

§ 371 (c)(1),
(2) Date: Apr. 28, 2017

(87) PCT Pub. No.: WO2016/065420

PCT Pub. Date: May 6, 2016

(65) Prior Publication Data

US 2017/0316723 A1 Nov. 2, 2017

(30) Foreign Application Priority Data

Oct. 31, 2014 (AU) ..... 2014904386
Mar. 17, 2015 (AU) ..... 2015900946

(51) Int. Cl.
*G09F 17/00* (2006.01)
*E04H 12/32* (2006.01)

(52) U.S. Cl.
CPC ..... *G09F 17/0091* (2013.01); *E04H 12/32* (2013.01); *G09F 17/00* (2013.01); *G09F 2017/0008* (2013.01)

(58) Field of Classification Search
CPC ..... G09F 17/0091; G09F 17/00; G09F 2017/0008; E04H 12/32
See application file for complete search history.

(56) References Cited

U.S. PATENT DOCUMENTS 659,280 A * 10/1900 Beaver ..... A45B 3/00 116/173
960,669 A * 6/1910 Morgan ..... G09F 17/00 116/173

(Continued)

FOREIGN PATENT DOCUMENTS

FR 2961620 A1 * 12/2011 ..... G09F 17/00
JP 11119714 A * 4/1999

*Primary Examiner* — Nimeshkumar D Patel
*Assistant Examiner* — Tania Courson
(74) *Attorney, Agent, or Firm* — William G Mitchell

(57) ABSTRACT

There is provided a flag assembly for mitigating against flag entanglement. The flag assembly comprises a flagpole assembly, the flagpole assembly having a fixed portion for fastening to a mount; a rotating coupling fastened to the fixed portion; and a rotating portion fastened to the rotating coupling such that the rotating coupling is able to rotate with respect to the fixed portion in use and a flag fastened to the rotating portion such that, in use, the fixed portion remains static while the rotating portion is able to rotate through 360 degrees under multidirectional wind force so as to mitigating against the entanglement of the flag about the flagpole assembly; wherein the rotating portion comprises an axial slot configured to allow the fastening of a portion of the flag to an interior of the rotating portion.

16 Claims, 9 Drawing Sheets

(56) References Cited

U.S. PATENT DOCUMENTS 1,305,885 A * 6/1919 Coe ..... G09F 17/00 116/173
1,312,426 A * 8/1919 Schmidt ..... G09F 17/00 116/173
2,061,361 A * 11/1936 Lane ..... E04H 12/32 116/173
2,441,875 A * 5/1948 Faber ..... B61L 5/125 246/488
3,587,520 A * 6/1971 Miller ..... E04H 12/32 116/173
3,996,882 A * 12/1976 Martin ..... G09F 17/00 116/174
4,800,834 A * 1/1989 Feng ..... E04H 12/182 116/173
4,917,343 A * 4/1990 Wainscott ..... A47B 23/06 248/284.1
4,920,910 A * 5/1990 Lin ..... G09F 17/00 116/173
5,005,512 A * 4/1991 Fu ..... E04H 12/182 116/173
5,374,024 A * 12/1994 Williams ..... G09F 7/18 116/173
5,396,915 A * 3/1995 Bomar ..... A45B 11/00 135/16
5,588,630 A * 12/1996 Chen-Chao ..... F16C 11/10 248/514
6,807,924 B1 * 10/2004 Christiansen ..... G09F 17/00 116/174
6,883,459 B2 * 4/2005 Maki ..... G09F 17/00 116/173
6,988,701 B1 * 1/2006 Lin ..... F16C 11/10 248/514
8,069,811 B2 * 12/2011 Ciaccia ..... G09F 17/00 116/173
8,141,839 B2 * 3/2012 Buchner ..... A63B 55/408 248/229.15
9,159,254 B2 * 10/2015 Oyoung ..... G09F 17/00
9,968,167 B2 * 5/2018 Volin ..... F16B 7/182
10,115,325 B2 * 10/2018 Scaturro ..... G09F 17/00
10,223,947 B2 * 3/2019 Butler, III ..... G09F 17/00
2001/0022153 A1 * 9/2001 Okumura ..... G09F 17/00 116/173
2005/0028722 A1 * 2/2005 Arntz ..... G09F 17/00 116/173
2009/0320740 A1 * 12/2009 Hume ..... G09F 17/00 116/173
2011/0260029 A1 * 10/2011 Kost ..... A45B 11/00 248/514
2016/0284254 A1 * 9/2016 Scaturro ..... G09F 17/00

* cited by examiner

FLAG ASSEMBLY FOR MITIGATING AGAINST FLAG ENTANGLEMENT AND A METHOD OF ASSEMBLY THEREOF

FIELD OF THE INVENTION

The present invention relates to flags and flagpoles and in particular, but not necessarily entirely, to a flag assembly for mitigating against flag entanglement and a method of assembly thereof.

BACKGROUND OF THE INVENTION

Flags are conventionally hoisted by way of a halyard passing through a pulley located at an upper end of the flagpole. In other applications, such as, for example, for real estate signage flags omitting the halyard, the flag may comprise a seam defining a lateral breadthwise pocket through which a flagpole (such as a 45° orientated flagpole) is fed to support the flag.

However, problems with existing arrangements is that the flag becomes tangled especially in multidirectional buffeting winds. In this manner, the flag usually becomes wrapped around the pole rendering the flag obscured to passers-by.

The present invention seeks to provide flag assembly, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

According to one aspect, there may be provided a flag assembly for mitigating against flag entanglement, the flag assembly comprising a flagpole assembly, the flagpole assembly comprising a fixed portion for fastening to a mount; a rotating coupling fastened to the fixed portion; and a rotating portion fastened to the rotating coupling such that the rotating coupling may be able to rotate with respect to the fixed portion in use; and a flag fastened to the rotating portion such that, in use, the fixed portion remains static while the rotating portion may be able to rotate through 360 degrees under multidirectional wind force so as to mitigating against the entanglement of the flag about the flagpole assembly.

The rotating portion may comprise an axial slot configured to allow the fastening of a portion of the flag to an interior of the rotating portion.

The flag assembly may further comprise a flag engagement configured to engage the flag and wherein, in use, the flag engagement may be configured for insertion into an interior of the rotating portion such that the flag extends from the interior of the rotating portion via the axial slot.

The flag may be seamed at an edge so as to define a pocket and wherein, in use, the pocket may be configured for receiving the flag engagement therein.

The flag engagement may be substantially elongate.

The flag engagement has a length selected in accordance with a length of the edge of the flag.

The flag engagement may be tubular.

The flag assembly may further comprise a clip configured for insertion into an interior of the flag engagement so as to clip the flag to the flag engagement.

The flag assembly may further comprise an end cap configured for fastening to an upper distal end of the rotating portion so as to retain the flag within the rotating portion.

The rotating coupling may be configured for insertion into respective distal ends of the rotating and fixed portions.

The rotating coupling may be sized so as to create a frictional engagement between at least one of the rotating portion and fixed portion and the rotating coupling.

The rotating coupling may comprise a fixed journal and a rotating journal.

The fixed journal and rotating journal are coaxial.

The fixed journal defines a stem configured for accommodation within at least a portion of the rotating journal.

The flag assembly may further comprise a rotational bearing between the fixed journal and the rotating journal.

The rotational bearing may comprise ballbearings.

The flag assembly may further comprise rotational bearings located at distal ends of the stem.

At least one of the fixed journal and rotating journal defines a collar to limit the travel of the rotating portion and fixed portion respectively.

The flag assembly may further comprise the mount and wherein the mount may comprise a socket and screw clamp fixed to the socket for clamping the socket to an upright support of a display.

The screw clamp may be fixed to the socket and a clamp screw passes diametrically through the socket in order to imprison the upright support between the screw and the clamp.

The screw may comprise a pad at one end for applying clamping force to the upright support and a ratchet device for applying torque over a restricted arc using a crank or handle.

The socket comprise a hollow portion for receiving and holding the captive end of the flagpole assembly and a solid threaded part through which the screw advances and retracts to exert clamping action.

According to another aspect, there may be provided a method of assembling a flag assembly comprising inserting an elongate flag engagement into an edge pocket of a flag; inserting the flag and flag engagement into an end of a rotating portion of a flagpole assembly such that at least a portion of the flag slides along an axial slot of the rotating portion.

The method may further comprise connecting the rotating portion to a rotating coupling.

The method may further comprise connecting the rotating coupling to a fixed portion of the flagpole assembly.

Other aspects of the invention are also disclosed.

BRIEF DESCRIPTION OF THE DRAWINGS

Notwithstanding any other forms which may fall within the scope of the present invention, a preferred embodiment/preferred embodiments of the disclosure will now be described, by way of example only, with reference to the accompanying drawings in which.

DESCRIPTION OF EMBODIMENTS

Figure 1:
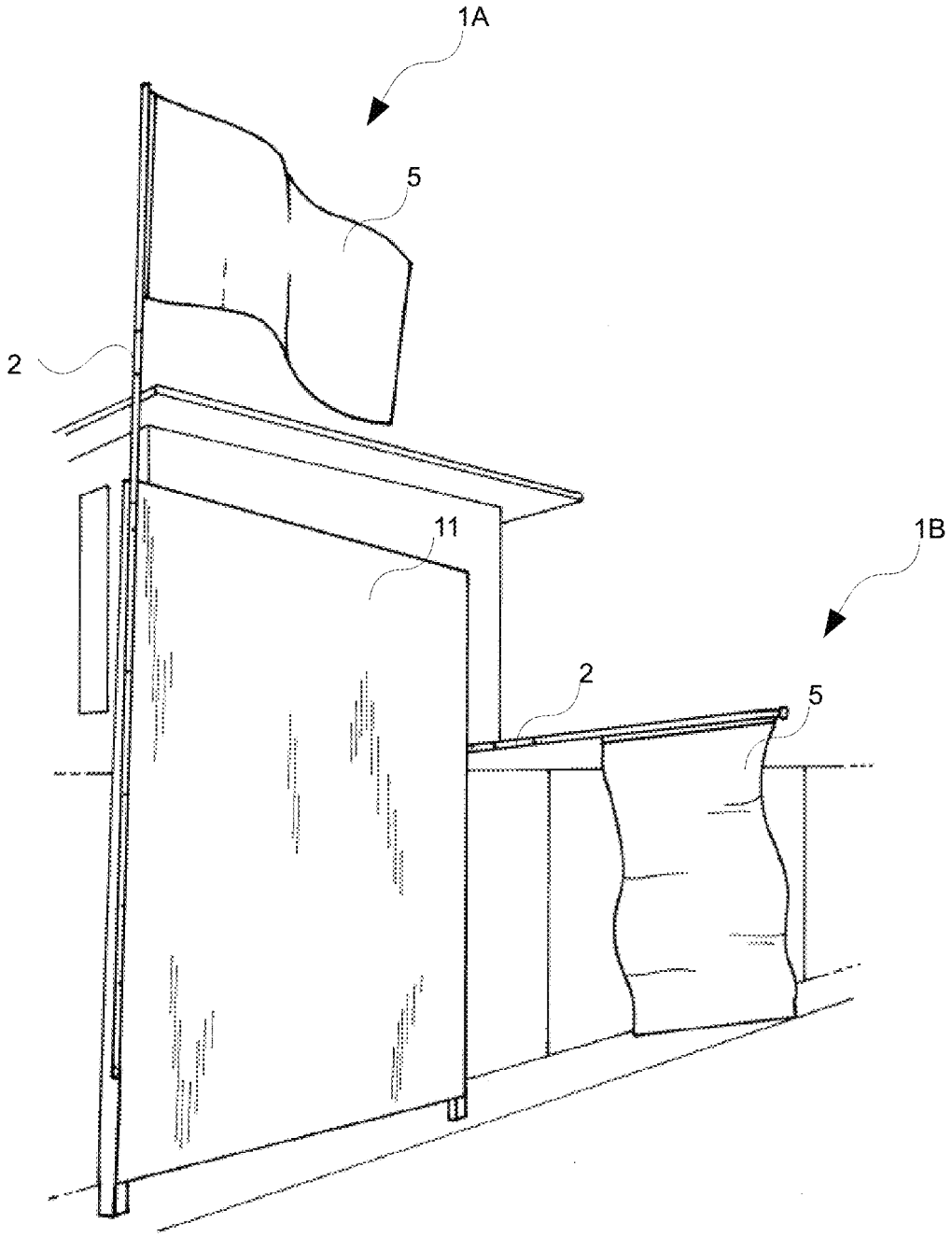
FIG. 1 shows an exemplary use case scenarios for a flag assembly in accordance with embodiments of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure.

Before the structures, systems and associated methods relating to the flag assembly are disclosed and described, it is to be understood that this disclosure is not limited to the particular configurations, process steps, and materials disclosed herein as such may vary somewhat. It is also to be understood that the terminology employed herein is used for the purpose of describing particular embodiments only and is not intended to be limiting since the scope of the disclosure will be limited only by the claims and equivalents thereof.

In describing and claiming the subject matter of the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterised by," and grammatical equivalents thereof are inclusive or open-ended terms that do not exclude additional, unrecited elements or method steps.

It should be noted in the following description that like or the same reference numerals in different embodiments denote the same or similar features.

Flag Assembly

Turning now to FIG. 1, there is shown a flag assembly 1. In the embodiment shown, and as alluded to above in the background section, the flag assembly 1 may be utilised as a conventional upright flagpole assembly 1A for displaying conventional flags and the like or as an advertising flag assembly 1B such as the above described real estate agent advertising flag assembly 1B which may be located to a flagpole stemming from a real estate agency signboard 11 or the like.

As will be described in further detail below, the flag assembly 1 is configured for overcoming or at least substantially ameliorating the problems of conventional flag assembly arrangements wherein flag becomes tangled and/or wrapped around the flagpole so as to become obscured during use.

It should be noted that the flag assembly 1 as will be described herein has wide applicability falling within the purposive scope of the embodiments described herein, including over and above those exemplary applications shown in FIG. 1.

Figure 2:
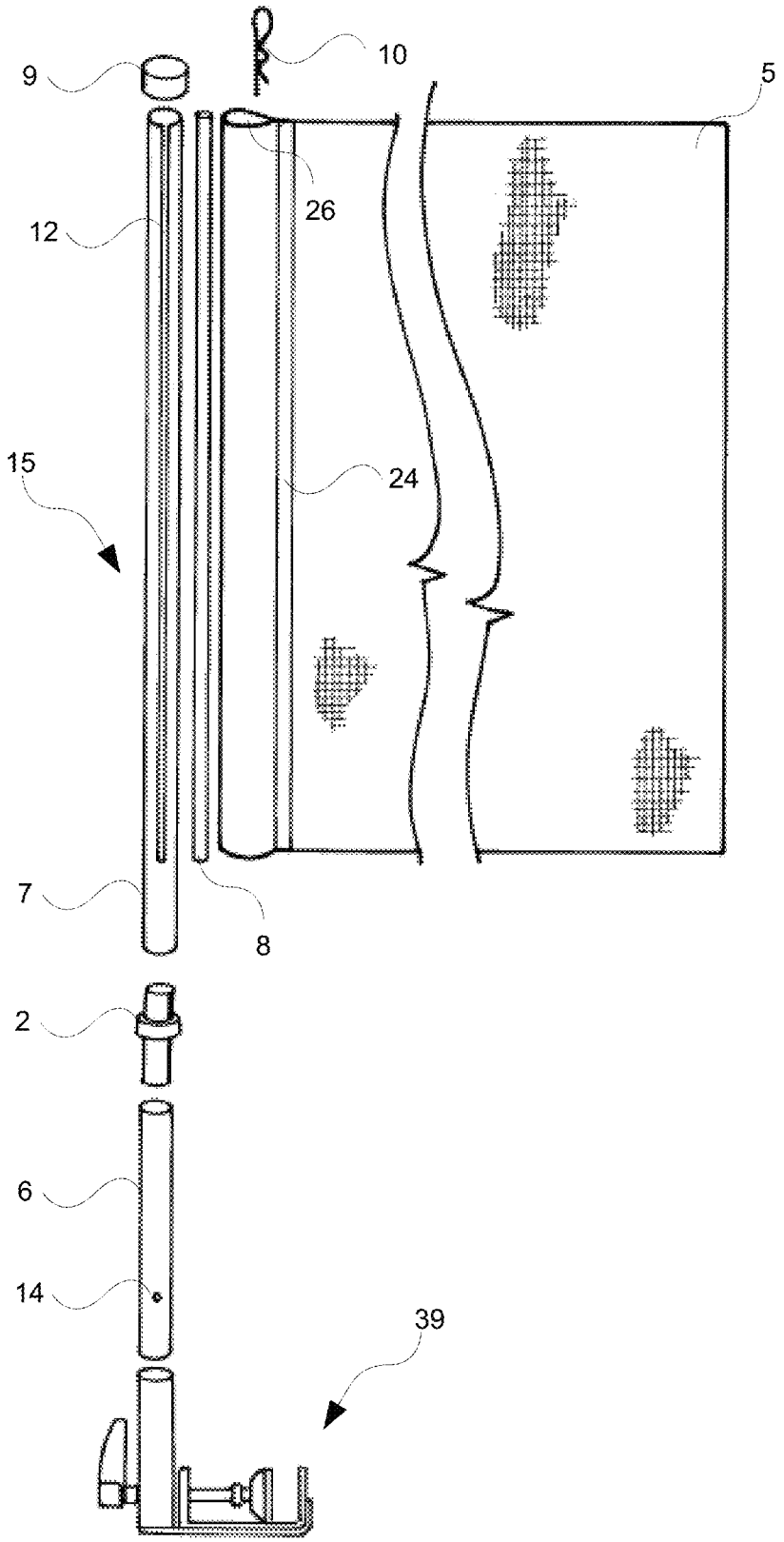
FIG. 2 shows an exploded view of the flag assembly in accordance with an embodiment of the present disclosure.

Now, turning to FIG. 2, there is shown the constituent components of the flag assembly 1.

As can be seen, the assembly 1 comprises a flag 5, such as a conventional material flag or the like. The flag 5 is fastened to a flagpole assembly 15. Now, as will be described in further detail below, flag assembly 1 is configured such that the flag 5 is able to rotate around the elongate axis of the flagpole assembly 15, so as to avoid entanglement.

Specifically, the flagpole assembly 15 comprises a rotating portion 7 operably coupled to a fixed portion 6 by way of rotating coupling 2. The rotating coupling 2 allows the rotating portion 7 to rotate with respect to the fixed portion 6 so as to prevent or at least substantially mitigate against the flag 5 becoming wrapped around the flagpole assembly 15.

Figure 3:
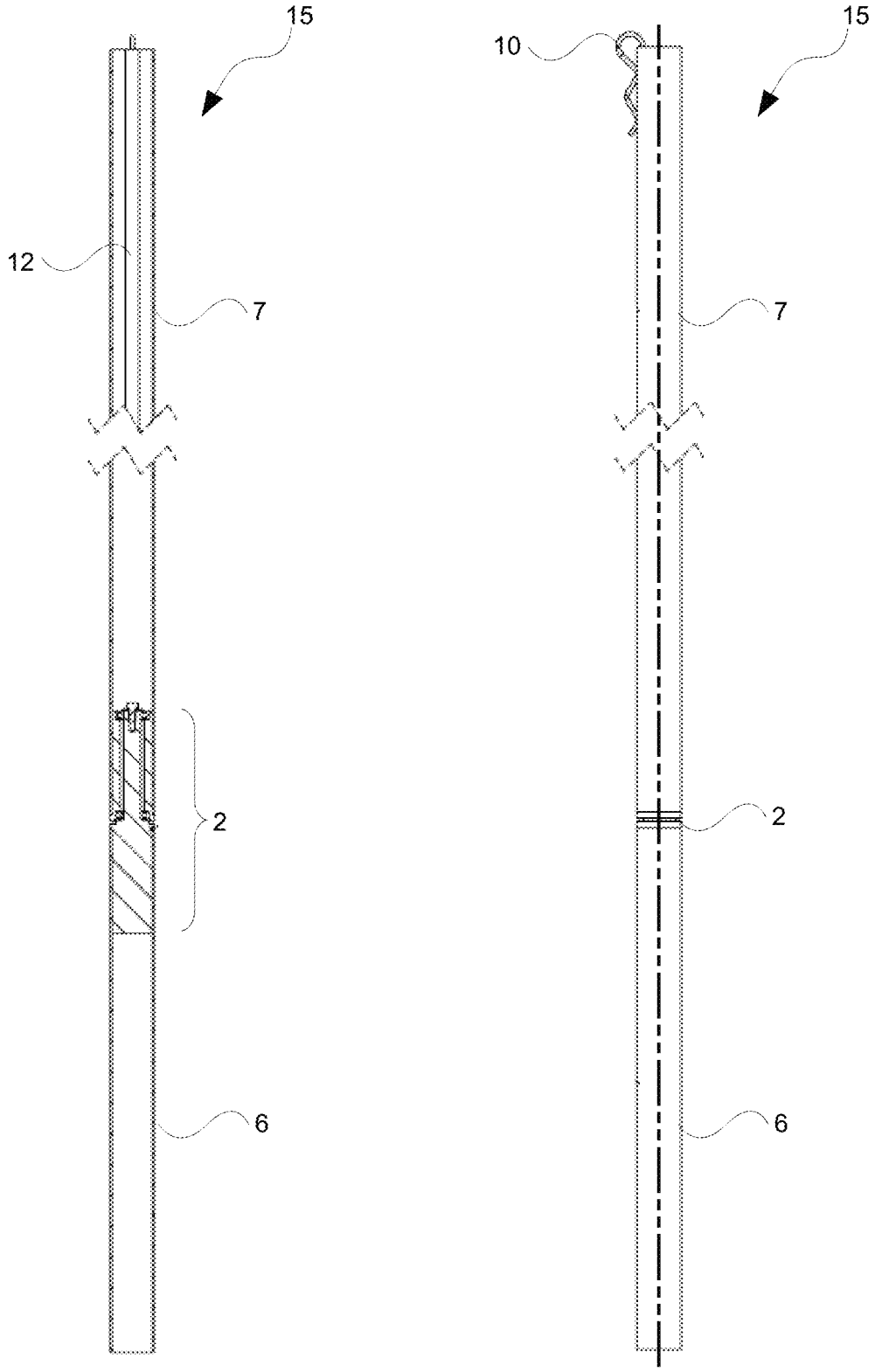
FIG. 3 shows views of a flagpole assembly of the flag assembly in accordance with an embodiment of the present disclosure.

Turning now to FIG. 3, there is shown the flagpole assembly 15 in further detail. Specifically, as can be seen, FIG. 3A shows a front elevation view of the flagpole assembly 15 and FIG. 3B shows a side elevation view of the flagpole assembly 15.

As can be seen, the rotating coupling 2 rotatably couples the fixed portion 6 to the rotating portion 7. In one embodiment, the fixed portion 6 may be approximately 390 mm long and the rotating portion 7 approximately 1200 mm long.

Turning again to FIG. 2, as can be seen, in a preferred embodiment, the rotating portion 7 comprises an axial slot 12. The axial slot 12 allows the engagement of the flag 5 within the flagpole assembly 15 as will be described in further detail below.

Specifically, in this preferred embodiment, the flag assembly 1 comprises a flag engagement 8 configured for accommodation within the rotating portion 7 in use. In one embodiment, the flag engagement 8 is substantially elongate and may be approximately 10 mm in diameter. The flag engagement 8 holds at least a portion of the flag 5 within the rotating portion 7 such that the flag 5 extends from the interior of the rotating portion 7 via axial slot 12.

Further specifically, in this embodiment, the flag 5 may comprise a seam 24 configured to define a lateral breadthwise pocket 26 for accommodating the flag engagement 8 therein.

As can be appreciated, such an arrangement negates the needs for halyards and the like which may restrict the ability of the flag 5 to rotate around the elongate axis of the flagpole assembly 15.

Method of Construction

There will now be provided an exemplary construction method for constructing the flag assembly 1 for illustrative purposes. It should be noted that the below described method is exemplary only and that no technical limitation should necessarily be imputed to the embodiments described herein accordingly. Furthermore, the exemplary construction methodology will be described with reference to the flag assembly 1 being utilised for the real estate agent advertising flag application as alluded to above.

Now, to construct the flag assembly 1, the real estate agent may connect the rotating portion 7 to the fixed portion 6 via the rotating coupling 2. In embodiments, the rotating coupling 2 is configured so as to slide into the respective distal ends of the rotating portion 7 and fixed portion 6.

Sizing of the rotating coupling 2 may be selected so as to create a frictional engagement of the rotating portion 7 and fixed portion 6 by the rotating coupling 2 so as to substantially prevent the inadvertent disengagement of the rotating coupling 2 in use. However, another embodiment, other mechanical arrangements may be utilised for the purposes of retaining the rotating coupling 2 within the rotating portion 7 and fixed portion 6 respectively, such as screw type mechanical engagements, protruding fasteners and the like.

Now, having constructed the flagpole assembly 15 in the manner described above, the real estate agent would then attach the flag 5.

Specifically, the real estate agent would insert the flag engagement 8 within the pocket 26 of the flag 5. As can be seen, the flag engagement 8 has a length approximately that of the breadth of the flag 5. For example, in this illustrative embodiment the flag has dimensions of approximately 900 mm×1200 mm. As such, the flag engagement 8 is substantially 900 mm in length.

Having inserted the flag engagement 8 into the pocket 26 of the flag 5, the real estate agent then inserts the flag engagement 8 and the flag into the upper end of the rotating portion 7 so as to slide the flag 5 along the axial slot 12. Similarly, the length of the axial slot 12 may be approximately that of the breadth of the flag 5, being 900 mm in this embodiment.

Thereafter, and so as to retain the flag 5 and flag engagement 8 within the axial slot 12, a plastic cap 9 may be inserted over or into the upper distal end of the rotating portion 7. The plastic cap 9 may form a frictional press-fit engagement within the rotating portion 7.

It should be noted, that in embodiments, the flag engagement 8 may be tubular. In this manner, and so as to hold the flag engagement 8 within the pocket 26, an R-clip 10 may be inserted into the interior of the flag engagement 8 so as to clip the flag 5 to the flag engagement 8.

Once having constructed the flag assembly 1 in this manner, the real estate agent would then insert the flag assembly 1 into an appropriate mount, which may take the form of the mount 14 as is described in further detail below.

In embodiments, the fixed portion 6 may comprise a mount fastener 14 configured for retaining the fixed portion 6 within the mount 14.

Figure 4:
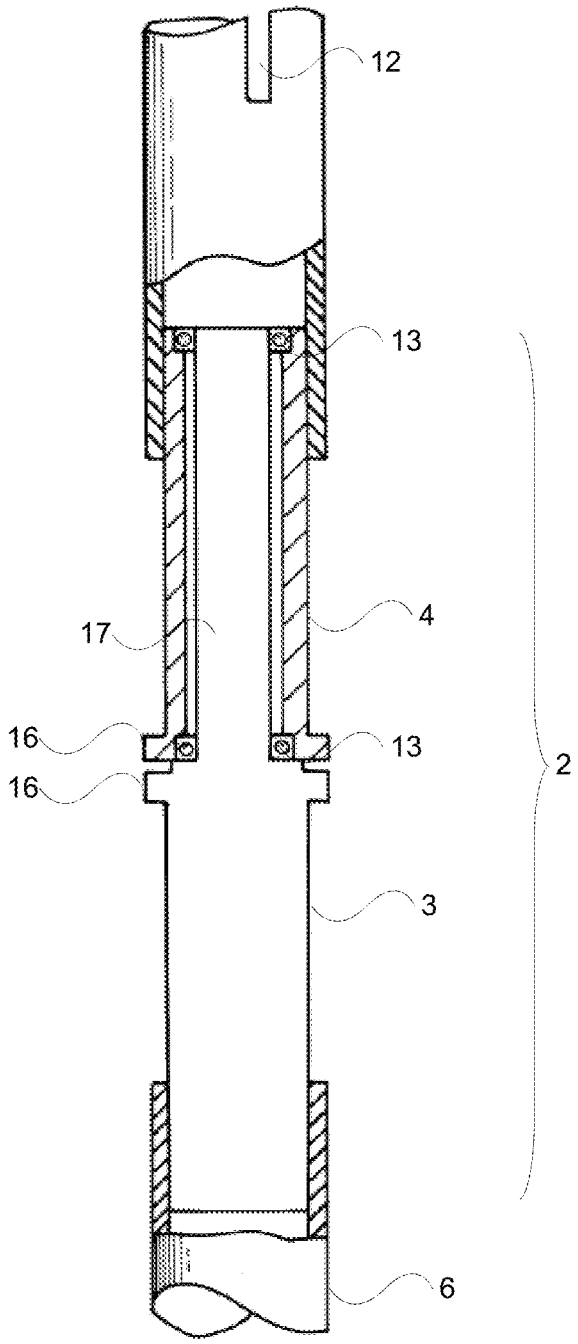
FIGS. 4-6 shows a rotating coupling of the flagpole assembly in further detail in accordance with an embodiment of the present disclosure
Figure 5:
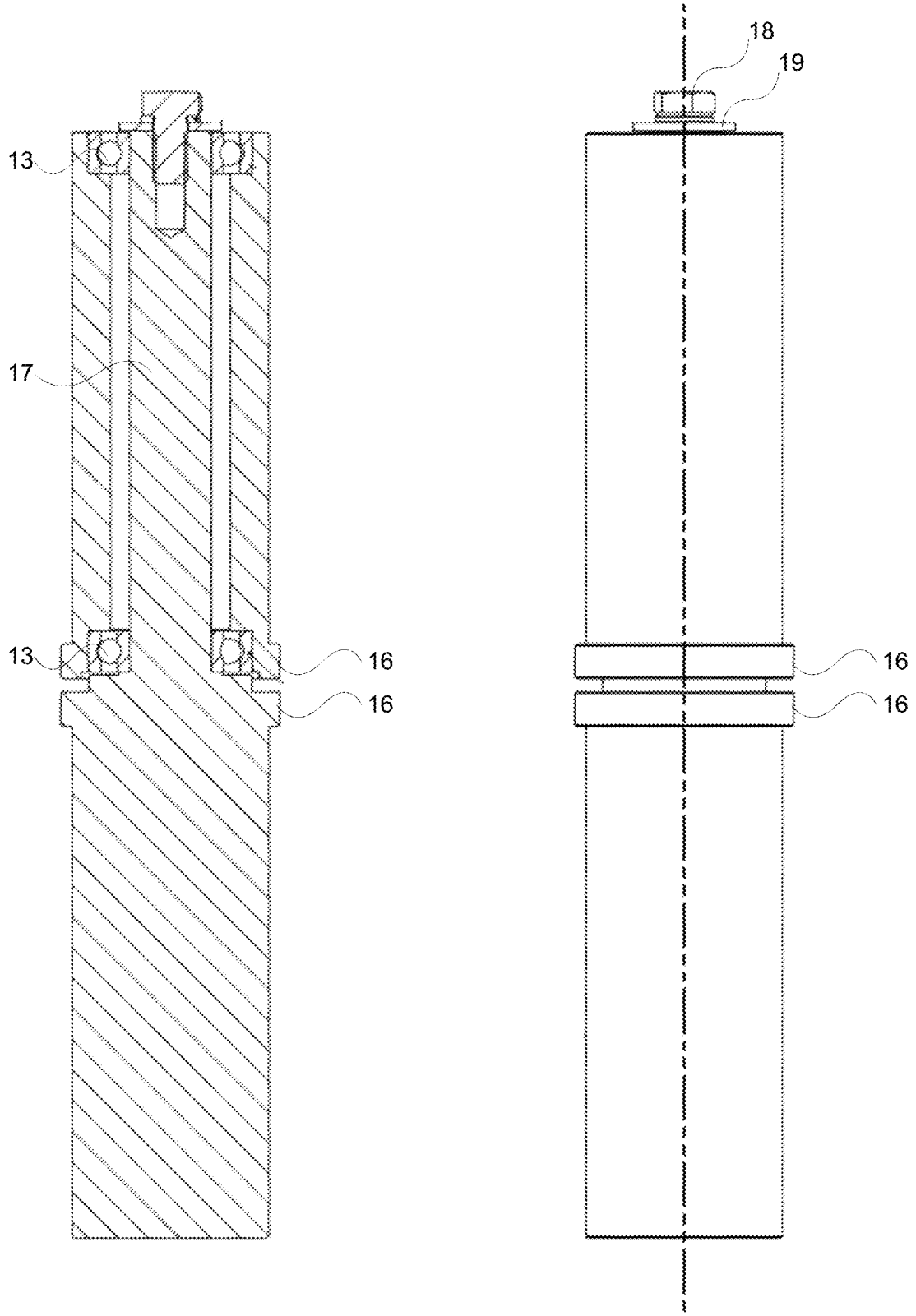

Turning now to FIGS. 4 and 5, there is shown the rotating coupling 2 in further detail. Specifically, as can be seen, in this embodiment, the rotating coupling 2 fits within the respective ends of the fixed portion 6 and the rotating portion 7.

In the embodiment shown, the rotating coupling 2 comprises a fixed journal 3 and a rotating journal 4. As can be appreciated, the rotating journal 4 rotates with respect to the fixed journal 3. The rotating journal 4 is coupled to the fixed journal 3 by way of a rotating mechanical engagement given by way of ballbearings 13 as is shown in the figures.

In this embodiment, the rotating journal 4 and the fixed journal 3 are coaxial, with the fixed journal 3 defining a stem 17 accommodated within the rotating journal 4. As can be seen, the ballbearings 13 are provided at opposite distal ends of the stem 17.

In the embodiment shown, the fixed journal 3 and the rotating journal 4 define collars 16 to limit the travel of the rotating portion 7 and fixed portion 6 respectively.

Figure 6:
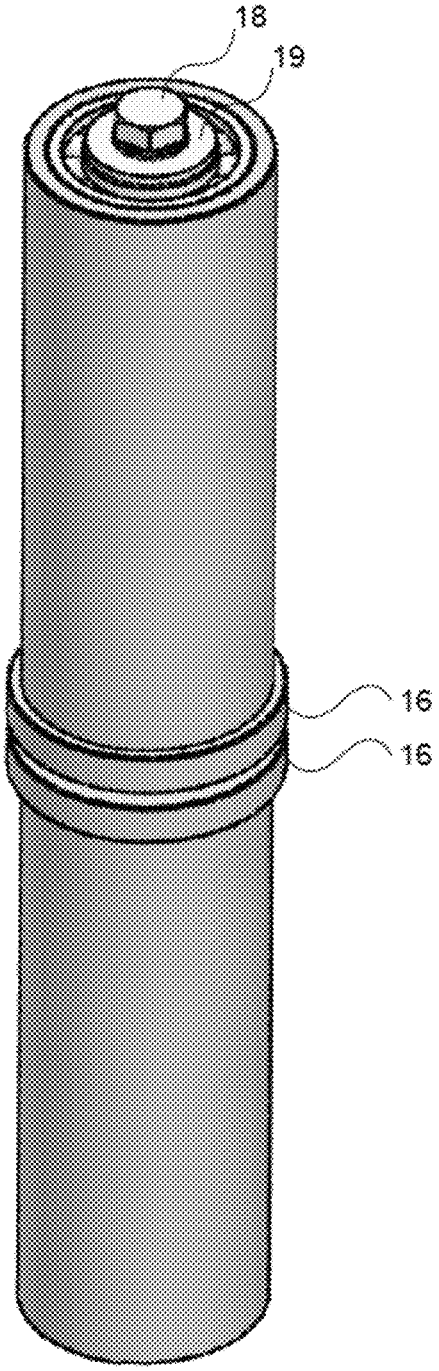

FIG. 6 shows a perspective view of the rotating coupling 2 in further detail where in a fastener 18 is apparent. The faster 18 is configured to fasten to the fixed journal 3 so as to press against washer 19 to bear against upper bearing 13.

Figure 7:
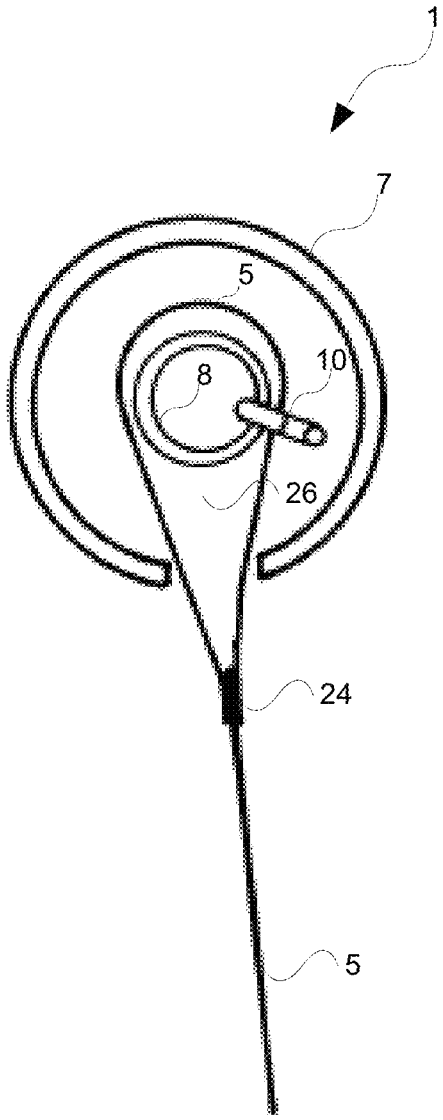
FIG. 7 shows a top view of the flag assembly in accordance with an embodiment of the present disclosure.

Turning now to FIG. 7, there is shown a top view of the flag assembly 1 showing the coaxial arrangement of the rotating portion 7, pocket 26 of the flag 5, flag engagement 8 and R-clip 10 respectively.

Mount 39

Figure 8:
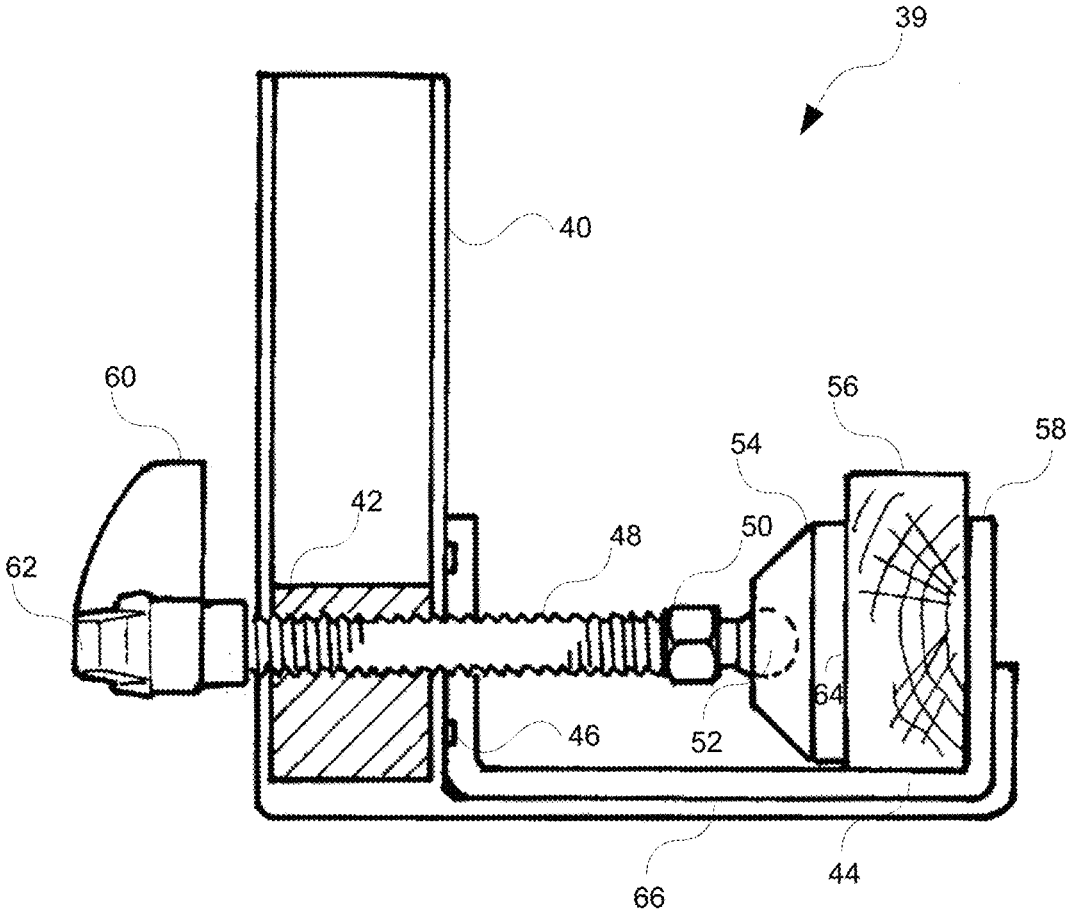
FIGS. 8-9 show amounting for the flag assembly in accordance with the further embodiment of the present disclosure.
Figure 9:
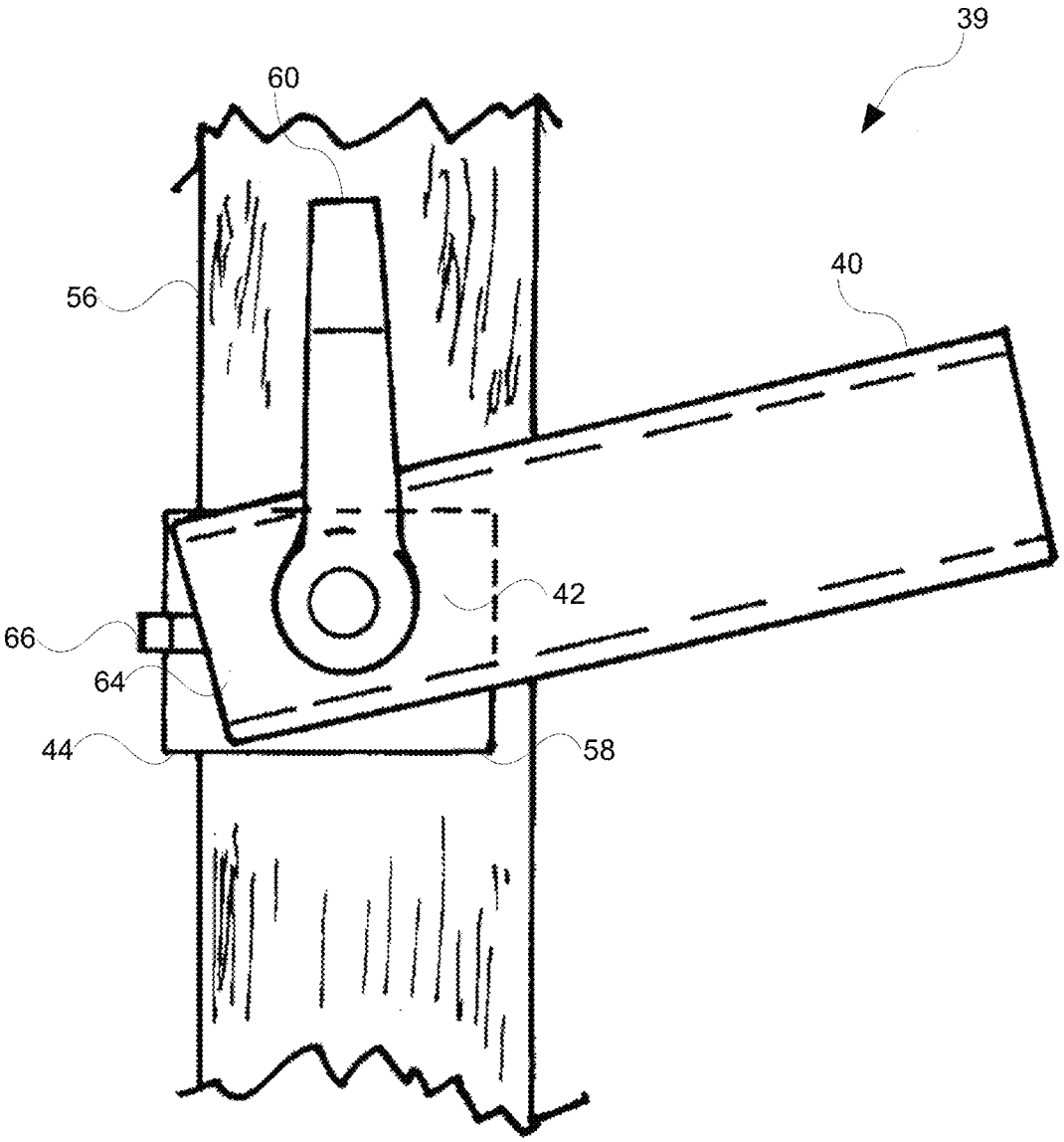

Turning now to FIGS. 8 and 9, there is shown a mount 39 for mounting the flag assembly 1 in embodiments.

The mount 39 allows the flag assembly 1 to be attached not just to fences and gates but to the posts of the display set up commonly placed outside the property.

Referring now to the drawings, the end of the flagpole assembly 15 slides into stainless steel socket tube 40 which is closed by stainless steel stop 42 attached to the socket tube by welding. The channel-section clamp body 44 adjoins the socket 40 in the region of the stop 42. Welds 46 between the socket wall and the fixed end of the clamp body 44 cause the socket 40 to lie at an angle (see FIG. 6) to the clamp body 44.

A clamp screw 48 passes through the wall of socket 40, the solid stop 42 and the fixed end 46 of the clamp. The leading end of the screw has a threaded metal thruster 50 terminating in a ball 52. The ball 52 projects into the spherical socket of a conical hard rubber pad 54 which compresses display board post 56 against the free end 58 of the clamp body 44.

The opposite end of the screw 48 has a plastic crank 60 with a ratchet 62 which allows the user to make small arcuate movements to operate the screw in both directions. The clamping surface is treated to increase its frictional hold on post 56.

As the screw is capable of appreciable thrust, the device is strengthened by welding an L-shaped metal support 66 to the end of stop 42, the fixed end 46 and the clamp body 44.

In u se the flagpole assembly and the mount are brought to the site. The screw 48 is unwound so that the clamp pad 54 can admit the width of the post 56. The mount height is then selected so the socket 40 then projects forward at 30-40°. The flagpole is then inserted into the socket 40.

Advantageous Effects

As can be appreciated from the foregoing the flag assembly 1 and mount 39 comprises advantages over conventional arrangements including:

The ability of the flag assembly 1 to untangle itself, especially during multidirectional buffeting when the conditions so as to substantially maintain the flag in an untangle configuration so as to be visible at all times;

The ability to exchange the flag 5 quickly and easily; and

The ability to mount the flag assembly 1 to both fences and signboard posts utilising mount 39.

Interpretation

Embodiments

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description of Specific Embodiments are hereby expressly incorporated into this Detailed Description of Specific Embodiments, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Specific Details

In the description provided herein, numerous specific details are set forth. However, it is understood that embodiments of the invention may be practiced without these specific details. In other instances, well-known methods, structures and techniques have not been shown in detail in order not to obscure an understanding of this description.

Terminology

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: including or which includes or that includes as used herein is also an open term that also means including at least the elements/features that follow the term, but not excluding others. Thus, including is synonymous with and means comprising.

Scope of Invention

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

Although the invention has been described with reference to specific examples, it will be appreciated by those skilled in the art that the invention may be embodied in many other forms.

The invention claimed is:

1. A flag assembly for mitigating against flag entanglement, the flag assembly comprising: a flagpole assembly, the flagpole assembly comprising:

a hollow fixed portion for fastening to a mount;

a rotating coupling comprising a single fixed journal and a rotating journal, such fixed journal partly located within the fixed portion and the rotating coupling fastened to the fixed portion, such fixed journal further comprising a stem located within the rotating journal, wherein the rotating journal is mechanically coupled to the fixed journal using ball bearings and the rotating coupling is configured for insertion into respective distal ends of a hollow rotating portion and the fixed portion;

the rotating portion comprising an axial slot, such rotating portion fastened to the rotating coupling such that the rotating coupling is able to rotate with respect to the fixed portion in use; and a flag fastened to flag engagement, embodied as a tube or rod, such flag engagement located within the rotating portion such that an inner edge of the flags is secured within such rotating portion by the flag engagement while the flag extends through the axial slot, such that the rotating portion is able to rotate through 360 degrees under multidirectional wind force while the fixed portion remains static.

2. A flag assembly as claimed in claim 1, wherein the flag is seamed at an edge so as to define a pocket and wherein, in use, the pocket is configured for receiving the flag engagement therein.

3. A flag assembly as claimed in claim 1, wherein the flag engagement is substantially elongate.

4. A flag assembly as claimed in claim 1, wherein the flag engagement has a length selected in accordance with a length of the edge of the flag.

5. A flag assembly as claimed in claim 1, wherein the flag engagement is tubular.

6. A flag assembly as claimed in claim 1, further comprising a clip configured for insertion into an interior of the flag engagement so as to clip the flag to the flag engagement.

7. A flag assembly as claimed in claim 1, further comprising an end cap configured for fastening to an upper distal end of the rotating portion so as to retain the flag within the rotating portion.

8. A flag assembly as claimed in claim 1, wherein the rotating coupling is sized so as to create a frictional engagement between at least one of the rotating portion and fixed portion and the rotating coupling.

9. A flag assembly as claimed in claim 1, wherein the fixed journal and rotating journal are coaxial.

10. A flag assembly as claimed in claim 1, wherein the ball bearings are located at distal ends of the stem.

11. A flag assembly as claimed in claim 1, wherein at least one of the fixed journal and rotating journal defines a collar to limit the travel of the rotating portion and fixed portion respectively.

12. A flag assembly as claimed in claim 1, further comprising the mount and wherein the mount comprises a socket and clamp screw fixed to the socket for clamping the socket to an upright support of a display.

13. A flag assembly as claimed in claim 12, wherein the clamp screw is fixed to the socket and a clamp screw passes diametrically through the socket in order to imprison the upright support between the clamp screw and a clamp.

14. A flag assembly as claimed in claim 13, wherein the clamp screw comprises a pad at one end for applying clamping force to the upright support and a ratchet device for applying torque over a restricted arc using a crank or handle.

15. A flag assembly as claimed in claim 12, wherein the socket comprises a hollow portion for receiving and holding the captive end of the flagpole assembly and a solid threaded part through which the clamp screw advances and retracts to exert clamping action.

16. A method of assembling a flag assembly comprising:

inserting an elongate flag engagement into an edge pocket of a flag;

inserting the flag and flag engagement into an end of a rotating portion of a flagpole assembly such that at least a portion of the flag slides along an axial slot of the rotating portion;

connecting the rotating portion to the rotating coupling of claim 1; and connecting the rotating coupling to a fixed portion of the flagpole assembly.

* * * * *